US006659799B2

(12) United States Patent
Yang

(10) Patent No.: US 6,659,799 B2
(45) Date of Patent: Dec. 9, 2003

(54) ELECTRICAL CONNECTOR

(75) Inventor: Sheng-Ho Yang, Taipei (TW)

(73) Assignee: Advanced Connectek Inc., Taipei Hsien (TW)

( * ) Notice: Subject to any disclaimer, the term of this patent is extended or adjusted under 35 U.S.C. 154(b) by 0 days.

(21) Appl. No.: 10/083,107

(22) Filed: Feb. 27, 2002

(65) Prior Publication Data

US 2002/0081903 A1 Jun. 27, 2002

Related U.S. Application Data

(63) Continuation-in-part of application No. 09/690,711, filed on Oct. 18, 2000.

(51) Int. Cl.[7] ..... H01R 13/648
(52) U.S. Cl. ..... 439/607; 439/79
(58) Field of Search ..... 439/607, 608, 439/609, 610, 570, 573, 79

(56) References Cited

U.S. PATENT DOCUMENTS 5,702,271 A 12/1997 Steinman ..... 439/676
6,012,948 A 1/2000 Wu ..... 439/567
6,056,600 A 5/2000 Watanabe et al. ..... 439/607
6,059,581 A 5/2000 Wu ..... 439/79
6,165,015 A 12/2000 Wu et al. ..... 439/607
6,168,467 B1 1/2001 Chiou ..... 439/607
6,179,661 B1 1/2001 Chiou ..... 439/607
6,231,389 B1 5/2001 Lai ..... 439/607
6,257,930 B1 7/2001 Yu ..... 439/607
6,290,540 B1 * 9/2001 Nishio et al. ..... 439/607
6,364,706 B1 * 4/2002 Ando et al. ..... 439/607

* cited by examiner

*Primary Examiner*—Hien Vu
(74) *Attorney, Agent, or Firm*—Troxell Law Office PLLC

(57) ABSTRACT

An electrical connector having an insulative housing including a connection end, an opposite end, two side walls, a bottom plate, two protection shoulders extended from bottom plate toward the opposite end, and a recess confined by protection shoulders; a metal shell wrapping around the insulative housing and including two side walls, a top plate, a connection cavity, and a coplanar engaged bottom piece in the recess; and a terminal assembly including a plurality of terminals received in a cavity of the insulative housing. This construction can enhance a structural strength of connection cavity and prolong a useful life. Also, it is possible to effectively prevent melted solder from flowing into the connector during soldering, thereby maintaining good electrical characteristics of the connector.

5 Claims, 4 Drawing Sheets

ELECTRICAL CONNECTOR

The present invention is a continuation in part (CIP) of the U.S. patent application Ser. No. 09/690,711 filed on Oct. 18, 2000, which is assigned to the applicant to the present invention, and the specification of the patent is incorporated into the present invention, as a part of the specification.

BACKGROUND OF THE INVENTION

1. Field of the Invention

The present invention relates to an electrical connector and more particularly to such an electrical connector with improved electrical connection and structural strength characteristics.

2. Description of Prior Art

Conventionally, an electrical connector is joined to a printed circuit board (PCB) by soldering. Typically, melted solder tends to flow into the connector along pins. As a result, electrical connection characteristics of the connector are adversely affected. With respect to currently popular surface mounting technology (SMT) employed in joining an electrical connector to a PCB, a sticky solder is first applied onto each of a plurality of predetermined positions on PCB. The terminals and attachment brackets of electrical connector are bent and attached to the predetermined positions, thus the initially fixing of the electrical connector is achieved by the adhesiveness of solder. Next, heat the solder until melted while applying soldering paste. After solder's cooling off, the electrical connector is affixed onto POB. However, melted solder tends to flow into the electrical connector and further onto PCT along pins. As a result, electrical connection of plugging and unplugging characteristics of the electrical connector are adversely affected.

Moreover, for enhancing the structural strength of the connector to withstand plugging and unplugging, in the attachment section of an electrical connector an insulative housing is wrapped by a metal shell. In addition, the metal shell forms an attachment opening in the front projected portion of the electrical connector so as to increase the length and area of the attachment section. The positioning pegs under the insulative housing usually limit the bottom flange of the attachment opening, however, the attachment opening is bent for facilitating a fastening. Thus, no sufficient support from metal shell is available, i.e., the structural strength is weak. This tends to damage the metal attachment opening portion, resulting in a shortening of useful life.

Thus, it is desirable to provide an electrical connector having good electrical connection characteristics and an enhanced structural strength of withstanding plug or unplugging of the connector in order to overcome the above drawbacks of prior art.

SUMMARY OF THE INVENTION

It is an object of the present invention to provide an electrical connector having a construction capable of effectively preventing melted solder from flowing into the electrical connector along attachment brackets during a process of joining to PCB. By utilizing this electrical connector, electrical connection characteristics thereof are well maintained.

It is another object of the present invention to provide an electrical connector wherein connection cavity thereof is sufficiently supported so as to enhance a structural strength of the electrical connector as well as prolong a useful life thereof.

To achieve the above and other objects, the present invention provides an electrical connector comprising an insulative housing including a connection end, an opposite end, two side walls, a bottom plate, a wing projected from either side wall, a terminal seat formed in the opposite end being spaced from the bottom plate for forming a space, a terminal receiving cavity for receiving terminal assembly formed in the space being extended through the housing, two protection shoulders being extended from the bottom plate toward the opposite end perpendicular to the side walls, and a recess confined by the protection shoulders on an underside of the terminal seat; a metal shell which wraps around the body and includes two side walls, a top plate, and first and second mating protrusions extended downward from both side walls of the housing respectively prior to being bent toward each other for forming a connection cavity and a coplanar engaged bottom piece in the recess for enhancing a structural strength of the connection cavity and prolonging a useful life of the connector; and a terminal assembly including a plurality of terminals received in the terminal receiving cavity.

Moreover, the first mating protrusion comprises a first protuberance and a projection and the second mating protrusion comprises a second protuberance and a dent so that the projection and the dent are matingly engaged together and the protuberances are engaged for being coplanar in the recess in response to the bending of the protrusions. Hence, bottom piece, connection cavity, and the protection shoulders are coplanar with the bottom plate so as to enhance a structural strength of connection cavity.

In addition, the provision of protection shoulders which are coplanar and extended from bottom plate toward opposite end enables an effective prevention melted solder from flowing into the electrical connector along attachment brackets during soldering, thereby maintaining good electrical characteristics of electrical connector.

Additionally, there are further provided a rear cover in the top plate opposite to the protrusions and two downward latched tabs extended from both ends of the rear cover so that when the rear cover is bent toward the connection end to engage the slots with the latched members, the connection end is substantially enclosed.

The above and other objects, features and advantages of the present invention will become apparent from the following detailed description taken with the accompanying drawings.

DETAILED DESCRIPTION OF THE PREFERRED EMBODIMENTS

Figure 1:
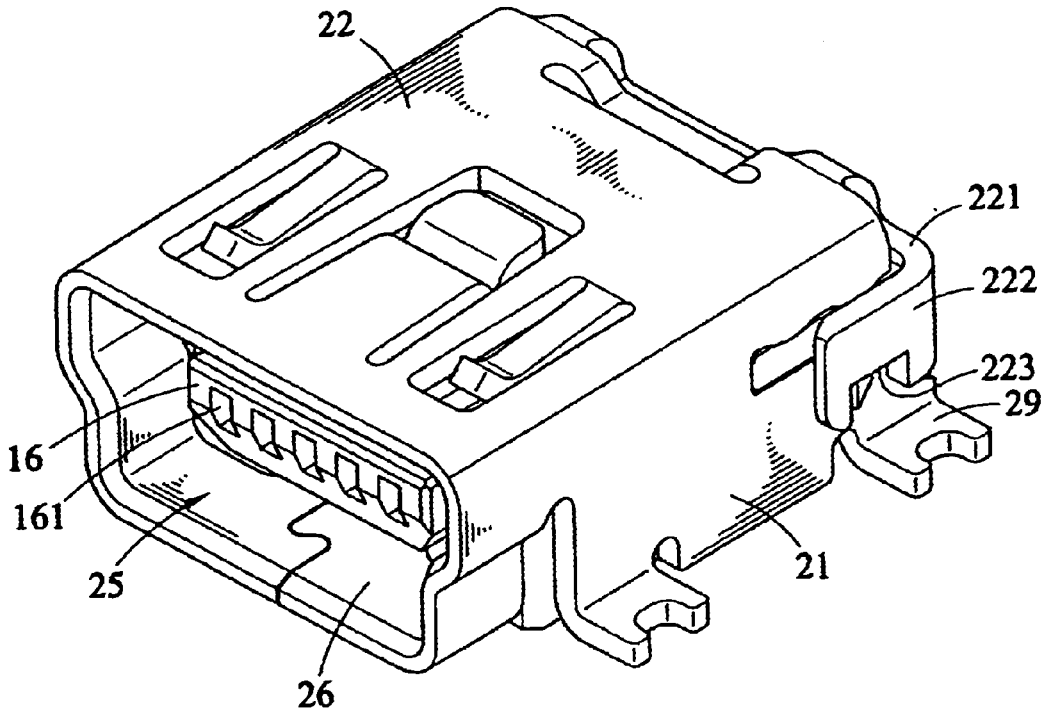
FIG. 1 is a perspective view of an electrical connector according to the invention.
Figure 2:
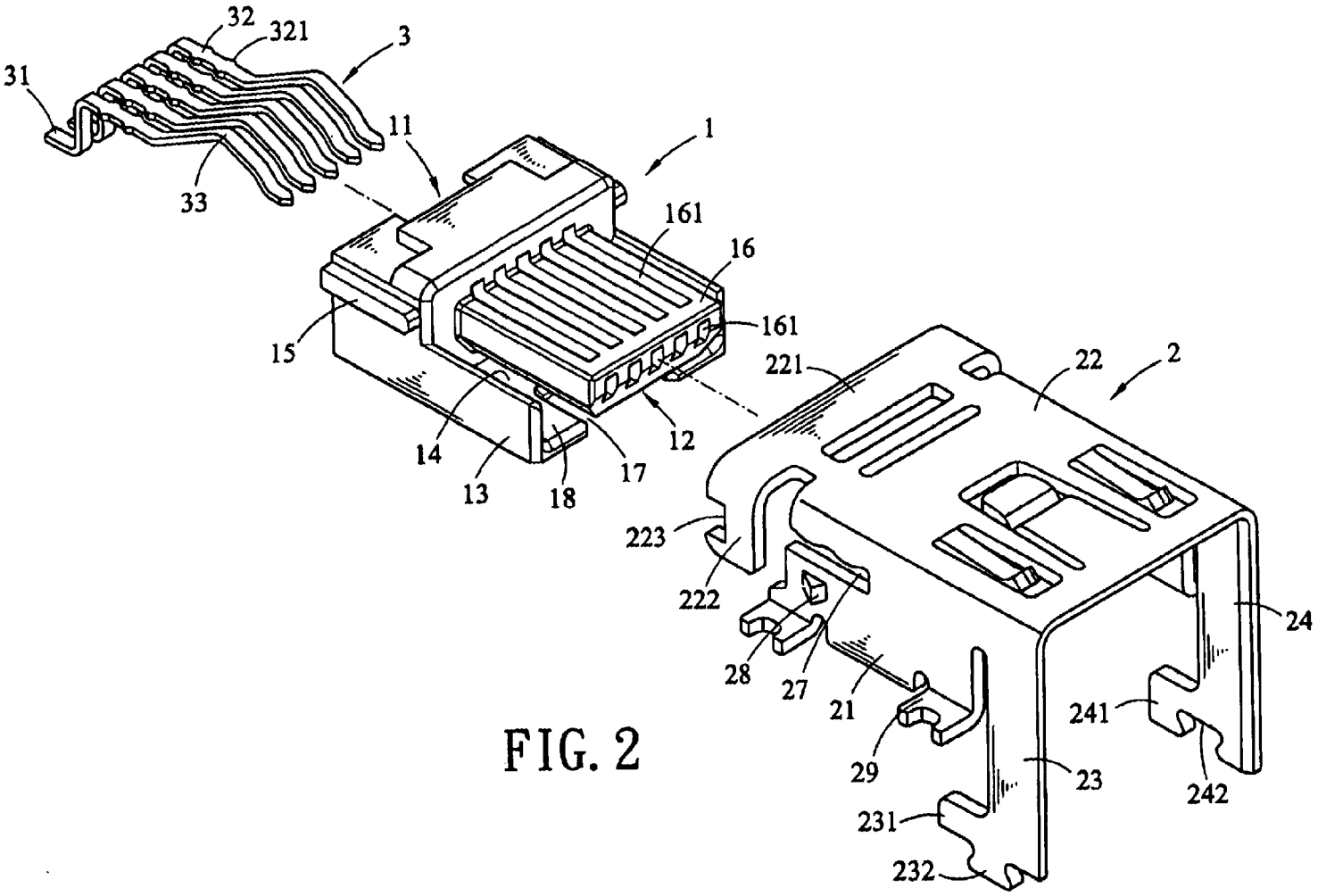
FIG. 2 is an exploded perspective view of the FIG. 1 connector.
Figure 3:
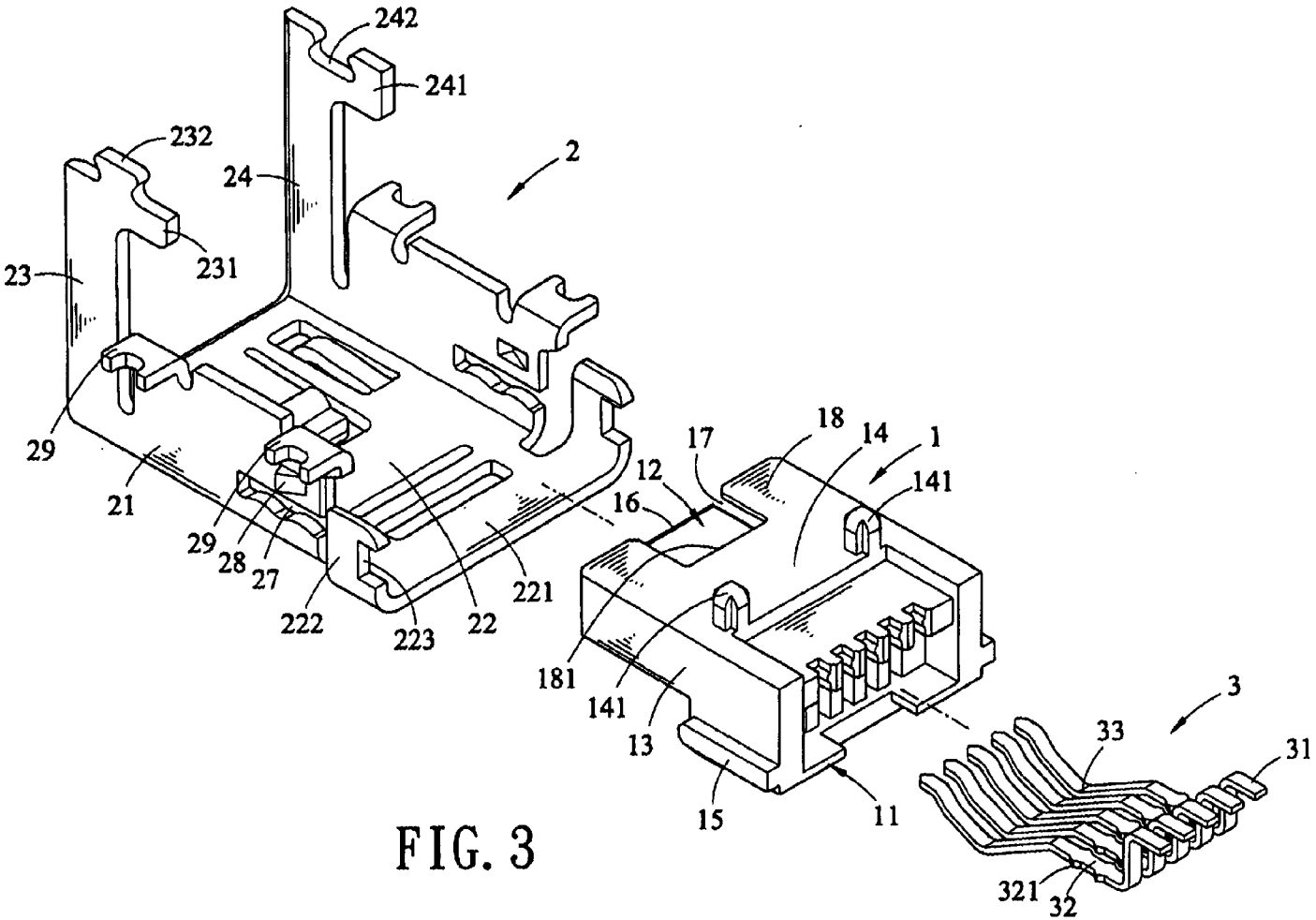
FIG. 3 is another exploded perspective view of the FIG. 1 connector in an angle reverse to that of FIG. 2.

Referring to FIGS. 1, 2 and 3, there are shown an electrical connector constructed in accordance with the invention. The connector comprises an insulative housing 1, a metal shell 2, and a terminal assembly 3. The insulative housing 1 has a connection end 11, an opposite end 12, two side walls 13, and a bottom plate 14. A wing 15 is projected from either side wall 13. A terminal seat 16 is formed in opposite end 12. Terminal seat 16 is spaced from bottom plate 14 to form a space 17. A plurality of terminal receiving cavities 161 is formed in space 17 extended through insulative housing 1. Terminal assembly 3 including a plurality of terminals is received in terminal receiving cavities 161. Two protection shoulders 18 are coplanar and extended from bottom plate 14 toward opposite end 12 perpendicular to side walls 13. A recess 181 is confined by protection shoulders 18 on the underside of terminal seat 16. Two positioning pegs 141 are spaced apart on bottom plate 14 for fixing on holes of PCB (not shown).

The metal shell 2 wraps around insulative housing 1 and comprises two side walls 21, a top plate 22, and first and second mating protrusions 23, 24 extended downward from both side walls 21 of one end of the metal shell 2 respectively wherein first mating protrusion 23 comprises a first protuberance 231 and a projection 232 and second mating protrusion 24 comprises a second protuberance 241 and an indentation 242. Further, on either side wall 21 there are provided a slot 27, a latched member 28, and two spaced attachment brackets 29. Furthermore, on the top plate 22 there is provided a rear cover 221, opposite to protrusions 23, 24 having a downward latched tab 222 extended from either end of rear cover 221, and a slot 223 on either latched tab 222.

As stated above, terminal assembly 3 including a plurality of terminals is received in terminal receiving cavities 161. Terminal assembly 3 further comprises a solder section 31 at one end being projected from terminal receiving cavities 161 for joining to PCB by soldering, an intermediate fixing section 32 having a plurality of latched pieces 321 for engaging terminal receiving cavities 161 so as to secure to terminal assembly 3, and an elastic section 33 at the other opposite end.

Figure 4:
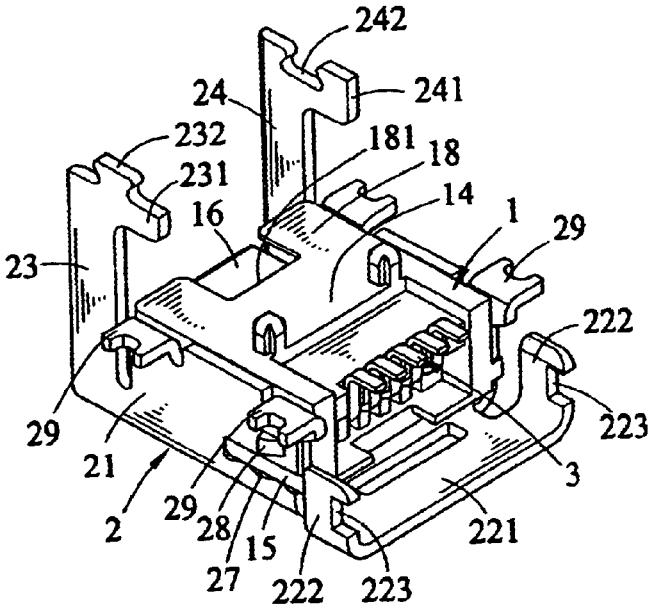
FIGS. 4, 5, and 6 are perspective views showing assembly processes of the connector according to the invention.
Figure 5:
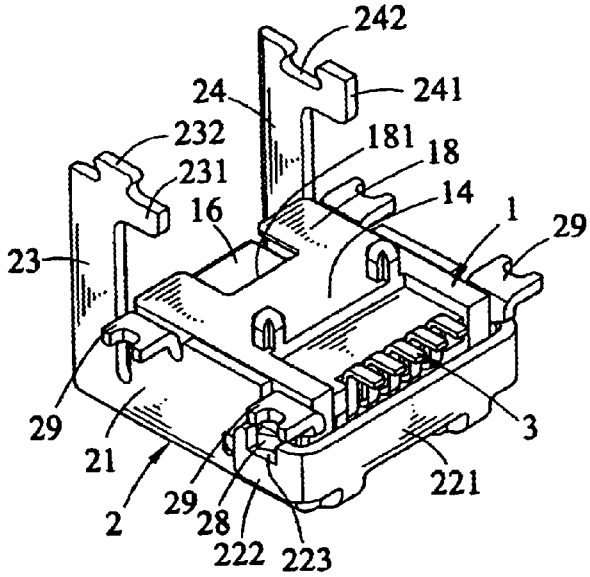
Figure 6:
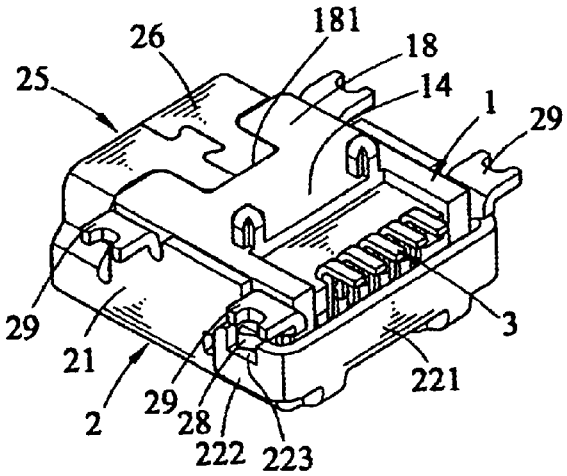

Referring to FIGS. 4 to 6, assembly processes of the connector will now be described. As metal shell 2 wrapping around insulative housing 1, wings 15 of insulative housing 1 are engaged with slots 27 of metal shell 2. The mating protrusions 23 and 24 are bent around the insulative housing toward each other so as to matingly engage projection 232 and indentation 242. As a result, connection cavity 25 and bottom piece 26 are formed in the front of opposite end 12 and in bottom end of opposite end 12 respectively. Connection cavity 25 is located external to terminal seat 16. The engaged Position of protuberances 231, 241 is at the recess 181, as shown in FIG. 6. Hence, bottom piece 26, and protection shoulders 18 are coplanar with bottom plate 14 so as to enhance a structural strength of connection cavity 25 and a capability of withstanding plugging or unplugging of the connector. As an end, a useful life of electrical connector is prolonged. Further, rear cover 221 is bent toward connection end 11 to engage slots 223 with latched members 28, thus enclosing most of connection end 11. Furthermore as stated above protection shoulders 18 are coplanar and extended from bottom plate 14 toward Opposite end 12 perpendicular to side walls 13, protection shoulders 18 are capable of effectively Preventing melted solder from flowing into the electrical connector along attachment brackets 28 during a SMT process of joining to PCB. As an end, electrical characteristics of electrical connector are not affected.

While the invention herein disclosed has been described by means of specific embodiments, numerous modifications and variations could be made thereto by those skilled in the art without departing from the scope and spirit of the invention set forth in the claims.

What is claimed is:

1. An electrical housing comprising:

a) an insulative housing having:
- i) a first end;
- ii) a second end;
- iii) two side walls;
- iv) a bottom plate;
- v) a terminal seat formed in the second end, the terminal seat having a plurality of terminal receiving cavities, the terminal receiving cavities extending through the insulative housing;
- vi) two protection shoulders extending from the bottom plate towards the second end, the two protection shoulders being coplanar with the bottom plate; and
- vii) a recess formed between the two protection shoulders;

b) a metal shell positioned around the insulative housing, the metal shell having:
- i) a shell top plate;
- ii) a first and a second shell side wall connected to the shell top plate, the first and the second shell side walls each having a latching member and two attachment brackets;
- iii) a first and a second mating protrusion extending from the first and the second shell side walls respectively, the first and the second mating protrusions being bent around the second end of the insulative housing and connected one to the other to form a connection cavity and a bottom piece; and
- v) a rear cover having two latching tabs, each latching tab having a first slot slot, the rear cover extending from the shell top plate at an end opposite the first and second mating protrusions, wherein the rear cover is bent toward the sidewalls and each of the first slots of the latching tabs engages a latching member to securely engage the first end of the insulative housing; and c) a plurality of terminals being inserted into the terminal receiving cavities, each terminal having a solder section at a first end, an elastic section at a second end, and an intermediate fixing section between the solder section and the elastic section, each intermediate section having a plurality of latching pieces for securing the terminals within the terminal receiving cavities.

2. The electric housing according to claim 1, wherein the first and the second shell side walls each having a second slot, the insulative housing having a wing extending from each of the two side walls, wherein one wing being inserted into each second slot.

3. The electric housing according to claim 1, wherein the insulative housing having a plurality of positioning pegs extending from the bottom plate.

4. The electric housing according to claim 1, wherein the first mating protrusion having a first protuberance and a projection, the second mating protrusion having a second protuberance and a indentation, wherein the projection is inserted into the indentation.

5. The electric housing according to claim 1, wherein the bottom piece of the metal shell being positioned within the recess of the insulative housing such that the bottom piece is coplanar with the bottom plate of the insulative housing.

* * * * *